US005138735A

United States Patent [19]

Kusz et al.

[11] Patent Number: 5,138,735

[45] Date of Patent: Aug. 18, 1992

[54] BUFFING PAD AND ATTACHMENT SYSTEM THEREFOR

[75] Inventors: John P. Kusz, Chicago; Roy N. Voss, Elgin; Nick Iliadis, Buffalo Grove, all of Ill.

[73] Assignee: Safety-Kleen Corporation, Elgin, Ill.

[21] Appl. No.: 671,005

[22] Filed: Mar. 18, 1991

[51] Int. Cl.[5] ..... B24D 13/14; B24D 13/20

[52] U.S. Cl. ..... 15/97.1; 15/49.1; 15/230; 51/170 T; 403/299

[58] Field of Search ..... 15/98, 97.1, 97.2, 49.1, 15/50.1, 230; 51/170 T, 177; 403/287, 299, 343; 279/1 Q, 1 T, 99

[56] References Cited

U.S. PATENT DOCUMENTS

| | | | |
|---|---|---|---|
| 4,662,024 | 5/1987 | Moench | 15/98 |
| 4,709,439 | 12/1987 | Warren et al. | 15/98 |
| 4,907,313 | 3/1990 | Roeker | 15/98 |

*Primary Examiner*—Edward L. Roberts

*Attorney, Agent, or Firm*—James T. FitzGibbon

[57] ABSTRACT

A buffing pad attachment system including a buffing pad and a drive element for use with a power buffer. The drive element has a threaded insert permitting attachment to a power buffer drive spindle and further includes a resilient body with a radial flange for supporting an associated buffing pad. The drive element also has a center body portion with a flexible wall collar with at least one screw threaded surface. The buffing pad includes a radial flange with one surface covered with buffing material, the other surface engaging the drive element support surface and a center portion having a screw threaded cylindrical collar for engagement with the collar on the drive element. Both the pad and the drive element are made from elastomeric materials and may thus be nondestructively separated from each other by unscrewing or, in the alternate, by intentional or unintentional deformation of the collar walls sufficient to disconnect the engaged collars.

9 Claims, 2 Drawing Sheets

FIG. 1
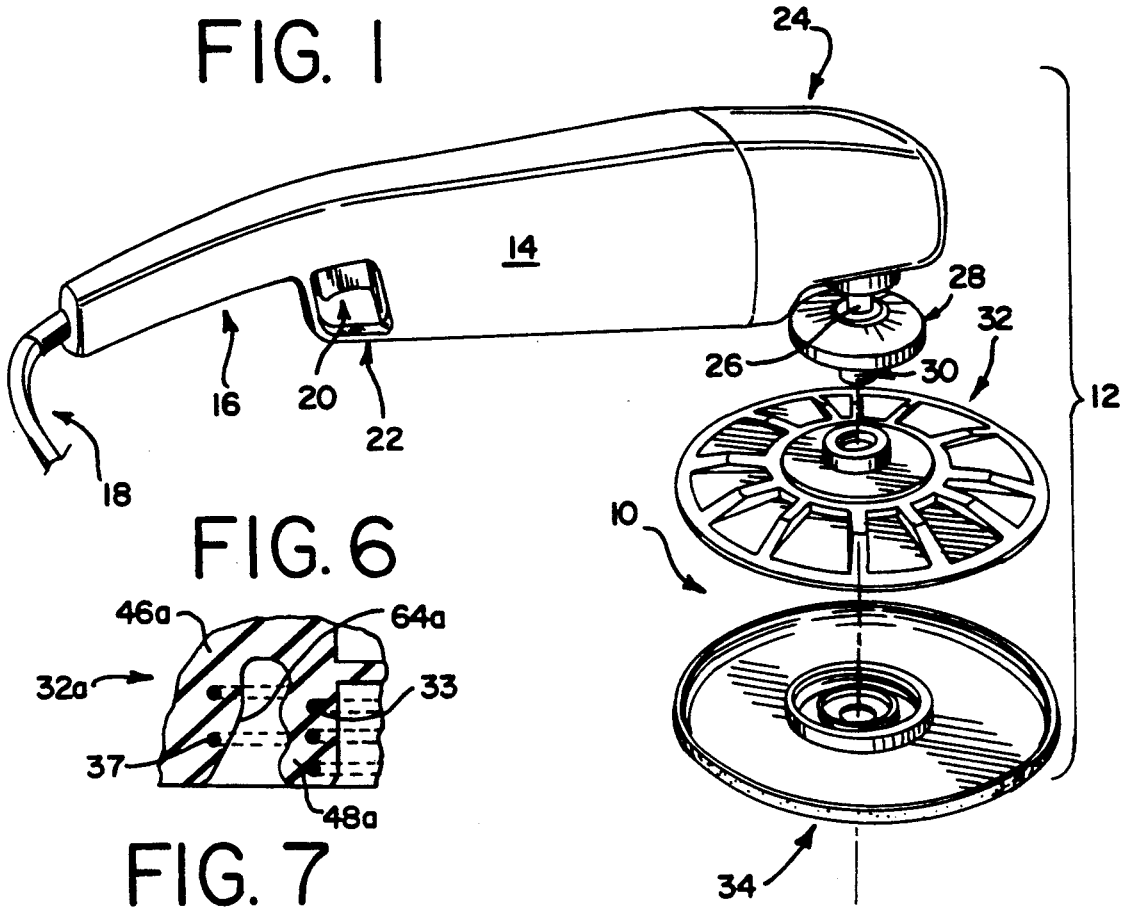
FIG. 6
FIG. 7
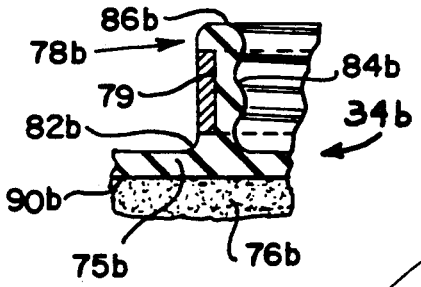
FIG. 2
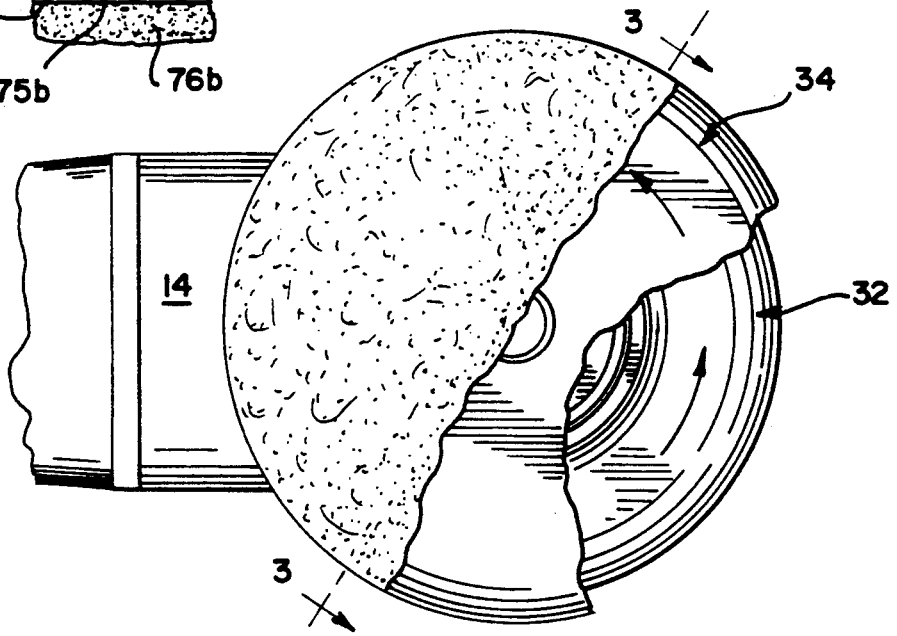

BUFFING PAD AND ATTACHMENT SYSTEM THEREFOR present invention relates generally to buffing pads used primarily in the automotive painting and refinishing industry, but also in other industries wherein surface finishing is achieved through buffing and polishing. In such industries, a buffing pad is removably affixed to a drive element forming a part of a hand-held, power driven polisher or grinder. More particularly, the invention relates to a novel attachment or connection system which overcomes problems characteristic of many prior art attempts to removably secure such buffing pads to their associated drive elements.

Traditionally, a power buffer or polisher used by refinishing technicians is a hand-held unit that includes a handle and trigger portion, a motor housing and a drive output system of some sort. Sometimes, this unit is also referred to as a "body grinder", for example, as is appropriate where the machine, with suitable changes of attachments, can serve multiple uses. Removable attachment of a buffing pad to the drive element can be accomplished in several ways, but in all or almost all cases, the attachment system is designed to permit the buffing pad to be periodically replaced for cleaning. Moreover, because a skillfully accomplished buffing operation involves applying light as well as strong forces to the surface to be treated, and because these forces must be the subject of relatively careful control by the operator, the polishing or buffing elements as a whole must provide a desired combination of stiffness and flexibility.

Customarily, in this connection, the drive element is in the form of a drive disk or backer unit of some sort which provides most of the stiffness, while its associated buffing pad is relatively thin. This construction is not always used, but is the most common form of arrangement because, with the buffer pad being a throw-away or reusable unit, it is not generally desired to have the pad possess the mass and stiffness of the relatively more permanent backup unit. However, the two units must combine in use to provide the desired combination of stiffness and flexibility for a wide range of applications.

Referring now to another common problem associated with buffer units, the amounts of force applied to, and the velocity of, the buffer surface relative to the underlying surface to be treated vary considerably because of the rotary action of the buffer. In other words, the tip or peripheral speed of a circular buffing pad is much higher than the speed at an intermediate portion, while there is no lineal velocity component at the exact center of the pad. As a consequence of this, the torque reaction to applying a buffing action relates to the area of contact between the buffer pad itself and the treated surface. The value of this force may in turn be altered by tilting the buffer relative to the drive axis so that relatively more or less of the buffing pad surface engages the surface being buffed or polished.

The observations contained herein are directed primarily to buffing and polishing operations, although it will be understood that many or all of the same considerations also apply to sanding or other abrasive treatment, as well as related surface finishing operations known to those skilled in the art.

Referring now to problems which have been largely associated with prior commercial buffing and polishing pads and their attachment to an associated grinder or polisher unit, one significant difficulty has been the manner of attaching the pad to the drive element, disk or other pad backing unit. In this connection, a relatively rigid or screw-on type attachment is often relatively expensive or impractical if made of metal, for example. In this connection, if a metal disk or nut is used for the purpose of pinching a buffer pad between the backup unit and the buffer pad, the surface of the metal nut may undesirably be exposed to or even contact the surface being polished.

Moreover, if formed of separable parts, the nut or like removable element may be lost, misplaced or damaged in use. If the elements are formed with the pad as a unit and made from metal, rust and corrosion may create problems if the buffing pad is to be cleaned by washing, for example.

Other attachment systems have been commonly used which are relatively labor intensive or require manipulation which is time consuming and/or unreliable. These include the kinds of pad covers or the like which include a peripheral string type arrangement that requires tying of a drawstring. This type arrangement often does not provide for a strong attachment as far as torque resistance is concerned. In other words, a pad attached merely by a peripheral drawstring may undesirably slip relative to the underlying drive element even under moderate torque forces.

With the advent of hook and loop fasteners, numerous proposals were made concerning attaching removable pads to discs in this way. However, exact centering has often been difficult, and an eccentric or off-center pad attachment, especially for high speed buffing creates erratic, difficult-to-control and irregular results.

Other systems intended to overcome one or more drawbacks characteristic of the prior art often presented their own difficulties, i.e., difficulty in intentional removal on the one hand or accidental removal on the other hand.

Still further, a number of prior art products were not tolerant of sufficient torque to be useful whereas other systems were fastened so securely that an underlying work surface or substrate could be damaged without the operator's knowing of such condition.

One or more of the foregoing drawbacks and disadvantages were also required to be considered in connection with cleaning or reconditioning the pad providing the buffing, polishing, or abrasive surface. In this connection, particularly because of the high cost of labor and the cost associated with keeping vehicles in storage for repair, it has been proposed that buffing pads be of a kind able to be supplied by a service company. Here, it would be advantageous if a buffing pad system could be provided which will be simple and almost fool-proof from the standpoint of attachment and removal, which would provide good operational flexibility, and which would be able to be cleaned and reused on an economical basis.

In view of the failure of the prior art to provide a buffing pad attachment system capable of superior performance at low cost, it is an object of the present invention to provide an improved buffer pad attachment system.

Another object of the present invention is to provide a buffer pad arrangement which includes a buffing pad drive element which is attachable to the output drive of a power buffer, and a separable buffing pad unit, with the pad drive element and the buffing pad unit including novel cooperating means permitting ready removal of the pad from the drive element.

A further object of the invention is to provide a buffer pad attachment system wherein the buffing pad and the drive element include cooperating elastomeric collars characterized by relatively coarse, cooperating thread arrangements for fastening.

A still further object of the invention is to provide a buffer pad attachment system wherein both the pad drive element and the buffing pad unit include an elastomeric threaded collar for mutual engagement, and wherein one or both of the collars are arranged for elastic deformation permitting non-destructive separation of the units by elastic deformation rather than separation by unscrewing the cooperating threads.

Yet a further object of the invention is to provide an attachment system which includes cooperating elastomeric collars on a buffing pad drive element and wherein a buffing pad unit, with the parts being constructed and arranged so that the torque able to be transmitted through the connection may be limited by design so as to prevent unintentional damage to the finish being treated.

Another object of the invention is to provide an attachment system which is readily aligned, self-centering, which is characterized by an even distribution of work forces and which may be attached and detached in virtually no time, even by workers using gloves or mittens, for example.

A still further object of the invention is to provide an elastomeric collar attachment system wherein the relative stiffness and elastic deformation of the collar may be limited or controlled by the selection of materials, and in which such stiffness and/or elastic deformation may be modified by the incorporation of metal or other stiffeners in one or both collars, for example.

Another object is to provide an arrangement as just described wherein one or both collars may be formed in connection with auxiliary elements, whereby one threaded collar is received in a threaded groove, for example.

Yet another object is to provide an arrangement whereby unintentional overtightening the attachment will not damage the connection or make removable difficult.

A still further object of the invention is to provide a relatively economical system whereby the overall stiffness and resiliency of the buffing pad system as a whole may be carefully controlled.

The foregoing and other objects and advantages of the invention are achieved in practice by providing a buffing pad attachment system which includes a buffing pad drive element having means for connection to the drive spindle of a hand held power buffer, a relatively flexible buffing pad support position including a pad contact surface for engaging a buffing pad unit in facing relation, a buffing pad unit having a work engaging surface, a surface in facing relation to the drive element and wherein the pad unit and the drive element include cooperating threaded collars made from an elastomeric material and constructed and arranged for non-destructive separation by an unscrewing action or by simple elastomeric deformation of the collar portions of one or both units.

The manner in which the foregoing and other objects and advantages of the invention are achieved in practice will become more clearly apparent when reference is made to the following detailed description of the preferred embodiment of the invention set forth by way of example, and shown in the accompanying drawings, wherein like reference numbers indicate corresponding parts throughout the various figures.

BRIEF DESCRIPTION OF THE DRAWINGS

FIG. 1 is an exploded perspective view of a hand-held power buffer unit, showing the principal features of the unit and also showing the portions of the buffing pad drive element, the buffing pad unit, and the novel attachment system for removably connecting the drive element to the pad unit;

FIG. 2 is an enlarged, fragmentary plan view, with portions broken away, showing certain features of the buffer unit, the pad drive element and the pad unit, taken looking toward the work-engaging surface of the buffing pad unit;

FIG. 6 is a further enlarged, fragmentary sectional view of a modified form of the invention, wherein the pad drive element includes an elastomeric collar reinforced by a stiffening band;

FIG. 7 is a further enlarged, fragmentary sectional view of a modified form of the invention, in which the buffing pad includes an elastomeric collar reinforced by a stiffening band;

DESCRIPTION OF THE PREFERRED EMBODIMENTS OF THE INVENTION

Figure 3:
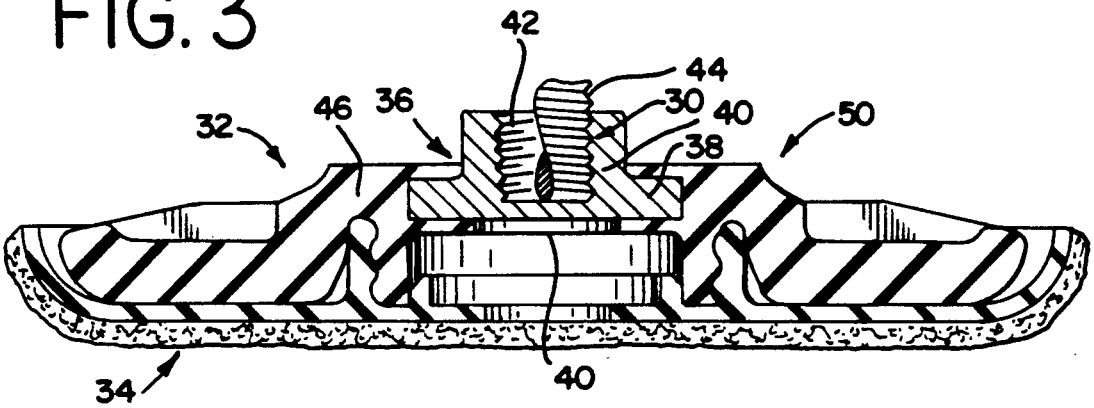
FIG. 3 is a vertical sectional view, taken along lines 3—3 of FIG. 2 and showing, on an enlarged scale, the buffing pad drive element and buffing pad unit, in a normal position of use.

While the objects and advantages of the present invention may be achieved in a variety of manners and whereby the invention may be practiced in different forms, a description will be made of one preferred form of the invention wherein a hand held, electrically driven power grinder, polisher or buffer is used, and wherein the buffing pad includes a working surface made from lamb's wool or other suitable polishing material.

Other changes in the detailed construction may be made according to the desires of the user without departing from the inventive concept.

Referring now to FIG. 1, a novel buffing pad attachment system generally designated 10 is shown to be embodied in a buffing pad arrangement generally designated 12 and shown to include a body grinder 14 of conventional construction. The grinder 14 includes a handle generally designated 16, a power cord generally designated 18 having one of its ends entering an end portion of the handle, and a trigger generally designated 20 and shown to be protected by a trigger guard 22.

An output or angle drive section generally designated 24 contains gears or the like (not shown) constructed and arranged relative to the motor (not shown) so that a drive spindle 26 lies at right angles to the long axis of the body grinder 14. In the form of apparatus shown, the spindle 26 terminates in an adapter 28 having drive means in the form of a stud 30 extending outwardly from the adapter 28. The stud 30 permits removable attachment of other pads or backers, such as those for abrasive grinding or the like, for example. It will be understood that in any case some means is usually placed intermediate the spindle 26 and the element used in surface treatment to permit removable attachment of such element.

Referring now to two of the principal elements of the invention, these comprise a buffing pad drive element generally designated 32, and a buffing pad unit generally designated 34. According to the invention, the attachment system for these parts provides a number of advantages and characteristics not heretofore available for reliable use at low cost.

Figure 4:
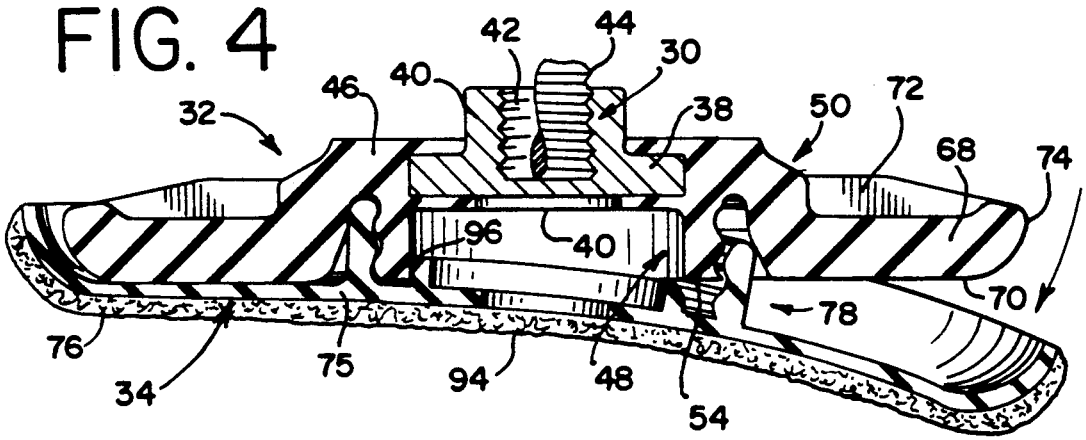
FIG. 4 is a view similar to FIG. 3, and showing a nondestructive separation of the buffing pad unit from the drive element, achieved by elastic deformation of the cooperating collars.
Figure 5:
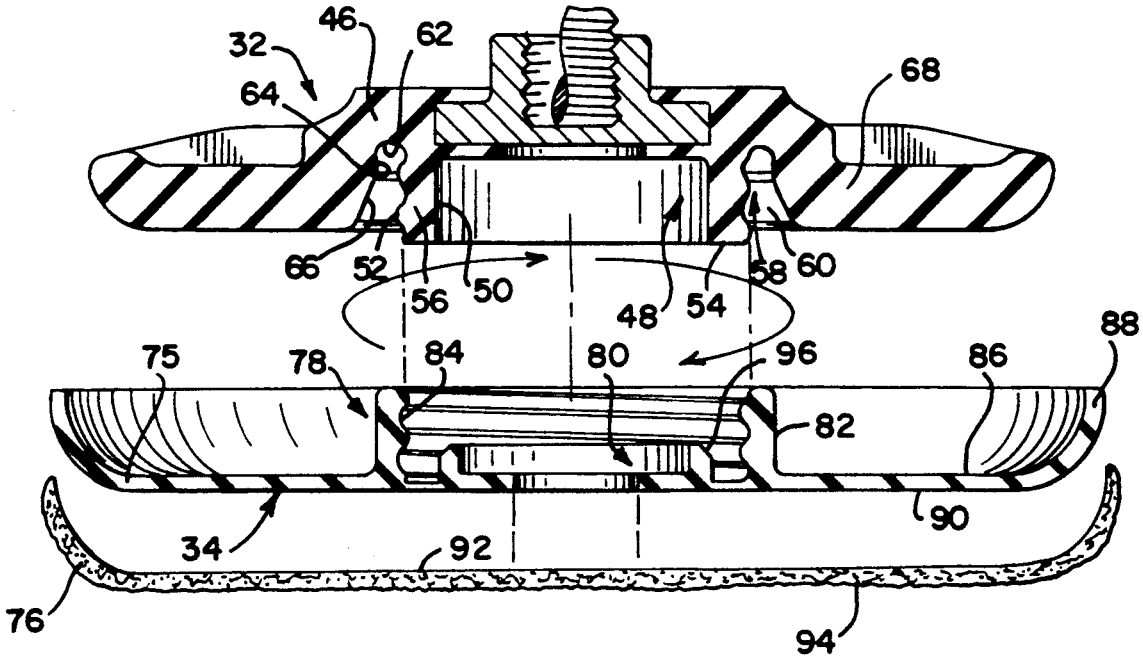
FIG. 5 is an exploded view of the drive element and buffing pad unit of FIGS. 3 and 4, showing the removal and attachment system using the cooperating threads achieved by unscrewing threaded collars relative to each other.

Referring now to FIGS. 3–5, the construction of the individual elements 32, 34 and their attachment to the stud 30 on the adapter 28, is illustrated. Referring first to the buffing pad drive element 32, in the form shown, this unit includes a fastener element generally designated 36, preferably made from metal and shown to include a radial flange or bonding portion 38, an axially extending neck 40, having a drilled and tapped center bore generally designated 42 for receiving the threaded outer surface portion 44 of the adapter stud 30. The flange 38 of the fastener element 36 is permanently bonded to a center body portion 46 of the pad drive element 32.

As is best shown in FIG. 5, the center body portion 46 of the buffing pad drive element 32 includes a pad fastening collar generally designated 48, defined in part by a radially inwardly directed, generally cylindrical surface 50, a threaded outer surface 52 and a lower end face 54. The wall 56 of the collar, in the embodiment of FIGS. 3–5 is free of stiffeners or other supports.

In the form of drive element 32 shown in FIGS. 3–5, the drive element center body 46 includes a radially spaced apart auxiliary stabilizing surface generally designated 58 (FIG. 5) and shown to be spaced radially apart from the threaded outer surface 52 of the collar 48 as to define between these surfaces a collar-receiving groove 60 having a bottom surface 62.

The surface 58 preferably includes both a cylindrical section 64 and a tapered section 66, for reasons discussed elsewhere herein. Additional portions of the buffing pad drive element 32 include means in the form of a solid radial flange 68 for supporting the buffing pad unit 34. The flange 68 includes a contoured surface 70 for engaging and supporting the pad 32, and circumferentially spaced apart stiffening ribs 72 which, in cross section, taper in part. The outermost margin 74 of the flange 68 is of rounded cross section so as to present a curved outer peripheral surface for the buffing pad drive element 32.

Referring now to the other principal element of the attachment system, and referring particularly to FIGS. 4 and 5, the buffing pad unit generally designated 34 is shown to include means in the form of a relatively thin, resilient elastomeric flange 75 for supporting a covering layer 76 of lambswool or the like, a collar generally designated 78 and a pilot land generally designated 80.

The collar unit 78 includes a radially outwardly directed cylindrical surface 82 and a radially inwardly directed threaded surface 84. The flange 75 includes an end face surface 86 in opposed facing relation to the contoured surface 70 presented by the drive element 32; the flange 75 also includes an upturned peripheral margin 88.

One surface 90 of the flange 75 engages and supports the layer 76 of the lambswool or other material comprising the actual buffing pad; this layer 76 has a surface 92 adhered to surface 90 and a working surface 94 which engages the work. The pilot land 80 of the pad 34 includes a tapered surface 96 to aid in centering the pad 34 relative to the drive element 32.

Whereas the lambswool pad 75 is shown separated from the pad 34 for purposes of illustration, it is understood that these parts will usually (but not necessarily) be fastened together for ease of cleaning, handling, etc.

Referring now to FIG. 6, a slightly modified form of the invention is shown. Here, a fragment of the drive element unit is generally designated **32*a*. This unit is virtually identical to its counterpart shown in FIGS. 3–5, except that the center body portion 46*a* of the buffing pad drive element 32*a* contains a plurality of loops 33 made from wire or the like. These wires serve to stiffen the pad fastening collar 48 to add stiffness thereto. FIG. 6 also shows that additional strands 37 of wire might be provided to create a similar reinforcing effect in an area of the center body 46*a* lying just outside the cylindrical wall 64*a***.

Referring now to FIG. 7, a modified form of buffing pad unit **34*b* is shown. Unlike its counterpart 34 in FIGS. 3–5, the form of buffing pad 34*b* shown in FIG. 7 includes a radial flange 75*b* having a surface 90*b* for supporting a layer 76*b* of lambswool or the like. This embodiment of the invention is substantially similar to the earlier described embodiment, except that the collar 78*b* is reinforced by a cylindrical stiffening band 79 of cylindrical cross section. The surfaces 82*b*, 84*b* and 86*b* are substantially the same as their counterparts in FIG. 5**, for example.

According to the invention, therefore, auxiliary means for stiffening either or both of the cooperating mounting collars 48, 78, may be provided. The invention may be practiced by using one stiffened or reinforced collar in cooperation with an unreinforced collar, or may be practiced using two collars, each of which is stiffened. The forms of stiffening means shown are primarily for purposes of illustration, it being understood that cylindrical stiffness might be desired to be imparted or hoop strength or the like might be desired to be increased, depending on the desires of the manufacturer and/or user, and of course as the stiffeners of the material from which the element 32 and the pad 34 are made. Therefore, for purposes of illustration, different representative forms of stiffeners are shown, it being understood that other forms of stiffeners may be used where desired.

Referring now to another aspect of the invention, the material from which the drive element 32 and the body of the buffing pad unit 34 are made may be made from different materials. However, a moderately soft but self-sustaining synthetic elastomer is preferred, such as a filled, nitrile rubber, for example. The drive element 32 is relatively stiff because of its thick cross section. The buffing pad itself is also made from a synthetic elastomer to provide resiliency in use. A thickness of about 0.080 to about 0.200 inches of thickness for the flange 75 is preferred, with one example of the invention proving successful when using a wall thickness of 0.125 inches. While the drawings are not to be taken as made to scale, they are somewhat generally in proportion to a form of apparatus which will operate successfully. In practice, a drive element 32 of the type shown and having an overall diameter of about seven to eight inches and a thickness of one inch to one and one-half inches at the center body portion of the drive element has proven workable.

Referring now to the operation of the unit, a very important feature of the invention is the flexibility provided by the attachment system. Assuming that the threaded stud 30 forms a part of the adapter 28 secured to the drive spindle 26, and further assuming it is desired to begin operations, the drive element 32 is aligned such that the drilled and tapped center bore 42 is aligned with the axis of the stud 30.

The drive element 32 is screwed on by hand with a clockwise rotation. Then, a new buffing pad is selected and the center of the pad 34 is coaxially aligned with the center of the drive element 32. With the pilot land 80 engaging portions of the collar 48 for tactile assistance in alignment, the parts are mated and the threads engage by rotating the pad 34 clockwise.

The coarse elastomeric threads are engaged and move to a locked position with about one-half turn of rotation. At this point, the collar 78 is fully seated in the groove 60 and the respectively opposed end faces 62, 86 are engaged with each other. Thereupon, a buffing operation may be commenced in the usual way. When separation of the buffing pad 34 from the drive element 32 is denied, the two pieces may be unscrewed relative to each other by rotation, or the two may simply be pulled apart by grasping an edge of the pad 34 and forcibly removing the parts 32, 34 from each other as shown in FIG. 4, for example. This may be done repeatedly without damaging the products because of the elastomeric nature of the thread mechanisms.

Referring now to the operation of the unit in use, if excessive torque is sought to be applied by pushing down toward the work surface with unduly great force, or by tilting the unit from its spindle axis and applying unduly great forces at the edge, the flexibility of the collar will permit the respectively engaged threaded portions to separate; this feature can provide a desirable safety factor.

Another advantage is that in aligning the pad and the drive and elements in registry, close attention to the position of the threads need not be maintained during this initial operation. Again, because of the elastomeric nature of the threads, when approximate alignment is achieved, an axial force will permit initial engagement of the threads and, using rotational force, the user can complete full engagement of the two parts. Thus, even if rotational action is not imparted to the two parts after they are engaged by a simple axial snapping in, whatever free play remains is immediately taken up as work begins, inasmuch as the pad will freely rotate into a fully locked position as soon as any measurable torque is applied to the periphery of the pad.

Referring now to an important advantage of the invention, the rubber materials used are those which are compatible with adhesives needed to apply a polishing or buffing material to the surface of the pad 34. Because of the relatively chemically inert nature of the pad when it is made from a rubber material, the pad may withstand repeated washing cycles. Hence, this attachment/detachment system of elastomeric collars and elastomer-back buffing pad render the system highly adapted to a service concept wherein the user may keep on hand a number of buffing or polishing pads, cloths or the like. Periodically, a service representative can collect the dirty and/or filled pads and replace them with a new supply. This eliminates the need for the user to either discard the entire pad or to engage in labor intensive washing or cleaning.

The simple and convenient combination of effortless changing and the ability to affix and remove the pad from the drive and support element using the thread action or by deformation of the collars is advantageous inasmuch as skilled labor or achieving precise handling is not required. A selection of drive elements or backing pads may also be provided so that differences in stiffness may be achieved to suit the demands of the user.

While the invention is primarily concerned with buffing and polishing pads whose surfaces are renewable by cleaning or laundering, the concept is not limited to such materials per se and is advantageous wherever any renewable covering is used, including covering such as abrasives or other coverings which might be replaced off-site by the above-referenced service personnel.

As pointed out above, otherwise essentially unsupported elastomeric collars possessing stiffness by reason of their cross section and the inherent stiffness of the material are advantageously used, but the stiffness and ready removability characteristics may be altered by reinforcing one or both of the collars as indicated, or otherwise may occur to those skilled in the art.

It will thus be seen that the present invention provides a new and useful attachment system for buffing pad or the like, such system having a number of novel advantages and characteristics, including those referred to specifically herein and others which are inherent in the invention. Preferred forms of the buffing pad system of the invention having been described in detail, by way of example, it is anticipated that other variations in the described form of construction may occur to those skilled in the art, and that such variations may be made without departing from the spirit of the invention or the scope of the appended claims.

We claim:

1. A buffing pad attachment system comprising, in combination, a buffing pad and a buffing pad drive element for use with a power buffer, said drive element having means for connection to the drive spindle of said power buffer, a stiff but resilient body portion including a radial flange having a surface adapted for supportingly engaging a part of an associate buffing pad unit positioned in opposed facing relation to said surface, and a center body portion coaxially aligned with said connection means and including a collar having a flexible wall with at least one of its surfaces including screw threads thereon, and a buffing pad unit made from a stiff but resilient material and having a flexible radial flange with two oppositely directed main surface portions, one of said main surface portions being covered with a buffing material for surface treatment of a substrate and the main surface portion being adapted to engage said support surface of said drive element in opposed facing relation, said buffing pad further including a generally cylindrical collar having a screw threaded wall portion, with said drive element collar and said buffing pad collar having their respective threaded portions sized and pitched for cooperative locking engagement, and with both said drive element and said buffing pad being made from an elastomeric material whereby said element and said pad are adapted for non-destructive separation by action of said cooperating screw threads or, in the alternative, by elastomeric deformation of at least one of said threaded collar portions relative to the other

2. A buffing pad attachment system as defined in claim 1 wherein said buffing material for surface treatment comprises a lambswool material attached to one of said main surface portions.

3. A buffing pad attachment system as defined in claim 1 wherein said buffing material for surface treatment material comprises an abrasive material affixed to one of said main surface portions.

4. A buffing pad attachment system as defined in claim 1 wherein said drive element body portion further includes a plurality of radially extending stiffening ribs extending between and joining said center body portion to a rear surface portion of said radial flange.

5. A buffing pad attachment system as defined in claim 1 wherein said flexible radial flange on said buffing pad includes a radially outer margin with a circumferential curl portion extending beyond and covering the radially outermost surfaces of said drive element radial flange.

6. A buffing pad attachment system as defined in claim 1 wherein at least one of said collars includes an auxiliary stiffening element disposed at least partially within said wall of said collar.

7. A buffing pad attachment system as defined in claim 6 wherein said stiffening element comprises a substantially cylindrical metal reinforcing member.

8. A buffing pad attachment system as defined in claim 6 wherein said stiffening element comprises a cylindrical coil of metal at least partially embedded within said collar wall.

9. In combination, a power buffer having a motor, a motor housing, and a drive spindle extending outwardly of said housing, a buffing pad and a buffing pad drive element, said drive element having means for connection to said drive spindle, a stiff but resilient body portion including a radial flange having a surface supportingly engaging a part of an associate buffing pad unit positioned in opposed facing relation to said surface, and a center body portion coaxially aligned with said connection means and including a collar having a flexible wall with at least one of its surfaces including screw threads thereon, said buffing pad unit being made from a stiff but resilient material and having a flexible radial flange with two oppositely directed main surface portions, one of said main surface portions being covered with a buffing material for surface treatment of a substrate and the main surface portion engaging said support surface of said drive element in opposed facing relation, said buffing pad further including a generally cylindrical collar having a screw threaded wall portion, with said drive element collar and said buffing pad collar having their respective threaded portions sized and pitched for cooperative locking engagement, and with both said drive element and said buffing pad being made from an elastomeric material, whereby said element and said pad may be nondestructively separated by action of said cooperating screw threads or, in the alternative, by elastomeric deformation of at least one of said threaded collar portions relative to the other.

* * * * *